US006803713B2

(12) United States Patent
Takahashi et al.

(10) Patent No.: US 6,803,713 B2
(45) Date of Patent: Oct. 12, 2004

(54) COLOR CATHODE RAY TUBE

(75) Inventors: Tohru Takahashi, Osato-gun (JP); Masatsugu Inoue, Kumagaya (JP); Shigeo Takenaka, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/015,626

(22) Filed: Dec. 17, 2001

(65) Prior Publication Data

US 2002/0079807 A1 Jun. 27, 2002

(30) Foreign Application Priority Data

Dec. 25, 2000 (JP) ..... 2000-392891

(51) Int. Cl.[7] ..... H01J 29/80
(52) U.S. Cl. ..... 313/402; 31/407; 31/408
(58) Field of Search ..... 313/402–408

(56) References Cited

U.S. PATENT DOCUMENTS 4,293,792 A * 10/1981 Roberts ..... 313/403
4,392,914 A * 7/1983 Takenaka et al. ..... 216/12
4,996,458 A * 2/1991 Hattori et al. ..... 313/402
5,079,477 A * 1/1992 Yamamoto ..... 313/403
5,686,784 A * 11/1997 Thoms et al. ..... 313/402

FOREIGN PATENT DOCUMENTS

| | | |
|---|---|---|
| JP | 60-243945 | 12/1985 |
| JP | 2-143759 | 12/1990 |
| JP | 5-41179 | 2/1993 |

* cited by examiner

*Primary Examiner*—Nimeshkumar D. Patel
*Assistant Examiner*—Gernan Colón
(74) *Attorney, Agent, or Firm*—Oblon, Spivak, McClelland, Maier & Neustadt, P.C.

(57) ABSTRACT

A shadow mask includes a shadow mask body opposed to a phosphor screen, and its peripheral portion is fixed to a mask frame. The shadow mask body includes a rectangular effective portion that is formed having a large number of electron beam passage apertures. The effective portion has a major axis and a minor axis that pass through its center and extends at right angles to each other. The shadow mask comprises an auxiliary mask fixed to a region that contains the minor axis of the effective portion of the shadow mask body. The auxiliary mask is in the form of a strip that extends long in the direction of the minor axis and has a large number of electron beam passage apertures that communicate individually with the electron beam passage apertures of the effective portion.

15 Claims, 6 Drawing Sheets

COLOR CATHODE RAY TUBE

CROSS-REFERENCE TO RELATED APPLICATIONS

This application is based upon and claims the benefit of priority from the prior Japanese Patent Application No. 2000-392891, filed Dec. 25, 2000, the entire contents of which are incorporated herein by reference.

BACKGROUND OF THE INVENTION

1. Field of the Invention

The present invention relates to a color cathode ray tube provided with a shadow mask.

2. Description of the Related Art

In general, a color cathode ray tube is constructed so that electron beams emitted from an electron gun are deflected in the horizontal and vertical directions by means of horizontally and vertically deflecting magnetic fields that are generated by a deflection yoke, and scan a phosphor screen horizontally and vertically through a shadow mask, thereby displaying a color image.

The shadow mask is used for color sorting such that the electron beams are landed on specific phosphor layers, and is located in a predetermined position relative to the phosphor screen. However, the shadow mask undergoes thermal expansion as it is hit by the electron beams, so that its position relative to the phosphor screen is shifted. Examples of measures to counter this problem are proposed in Jpn. Pat. Appln. KOKAI Publications Nos. 60-243945 and 5-41179 and Jpn. UM Appln. KOKAI Publication No. 2-143759. According to these measures, a part of the shadow mask that is susceptible to thermal expansion is doubled in structure so that its heat capacity and strength are increased.

In prevailing color cathode ray tubes, the shadow mask is formed of a material with a low coefficient of thermal expansion, such as an Invar material, or its curved surface is deliberately shaped to cope with the problem of thermal expansion.

On the other hand, flat tubes have recently started to spread. One such flat tube is a cathode ray tube of which the outer surface of the panel is substantially flat, having a radius of curvature of 100 m or more. Usually, an effective portion of the shadow mask in which electron beam passage apertures are formed has a flat shape corresponding to the shape of the inner surface of the panel. Accordingly, the shadow mask of the flat tube has a curvature smaller than that of a shadow mask of a conventional color cathode ray tube of which the outer surface of the panel is curved.

If the curvature of the shadow mask is reduced in this manner, it is hard for the shadow mask itself to maintain its curved surface, resisting the shadow mask own weight or external force. If the curved surface retention of the shadow mask (hereinafter referred to as mask strength) is low, the curved surface of the shadow mask is inevitably deformed by a small external force that acts on it during the manufacture or transportation. A deformation of the shadow mask changes the distance between the electron beam passage apertures and the inner surface of the panel. In consequence, the electron beams fail to be landed on the specific phosphor layers, thereby causing a color drift.

If the mask strength is low, moreover, the curved surface of the shadow mask easily resonates with vibrations, such as the sound from a speaker, when the mask is incorporated in a TV set or the like. If the shadow mask resonates, unnecessary light and shade appear on the screen plane, leading to a lower quality image.

The easiest method to prevent lowering of the mask strength is to thicken the shadow mask. However, if the thickness of the shadow mask is increased, etching control during the manufacture of the mask is so difficult that the electron beam passage apertures are subject to substantial irregularity in diameter. In consequence, the yield of production of shadow masks and color cathode ray tubes lowers, uneven display is caused, and the image quality level is lowered.

BRIEF SUMMARY OF THE INVENTION

The present invention has been contrived in consideration of these circumstances, and its object is to provide a color cathode ray tube provided with a shadow mask having satisfactory strength and capable of producing images of higher quality levels.

In order to achieve the above object, a color cathode ray tube according to an aspect of the invention comprises a panel provided with a phosphor screen, an electron gun configured to emit an electron beam toward the phosphor screen, and a shadow mask assembly located between the phosphor screen and the electron gun. The shadow mask assembly includes a shadow mask body having a rectangular effective portion opposed to the phosphor screen and formed having a number of electron beam passage apertures, the effective portion having a major axis and a minor axis passing through the center thereof and extending at right angles to each other, a mask frame to which the periphery of the shadow mask body is fixed, and an auxiliary mask in the form of a strip long in the direction of the minor axis, fixed to a region containing the minor axis of the effective portion, and having a number of electron beam passage apertures communicating individually with the electron beam passage apertures of the effective portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Color cathode ray tubes according to embodiments of the present invention will now be described in detail with reference to the accompanying drawings.

Figure 1:
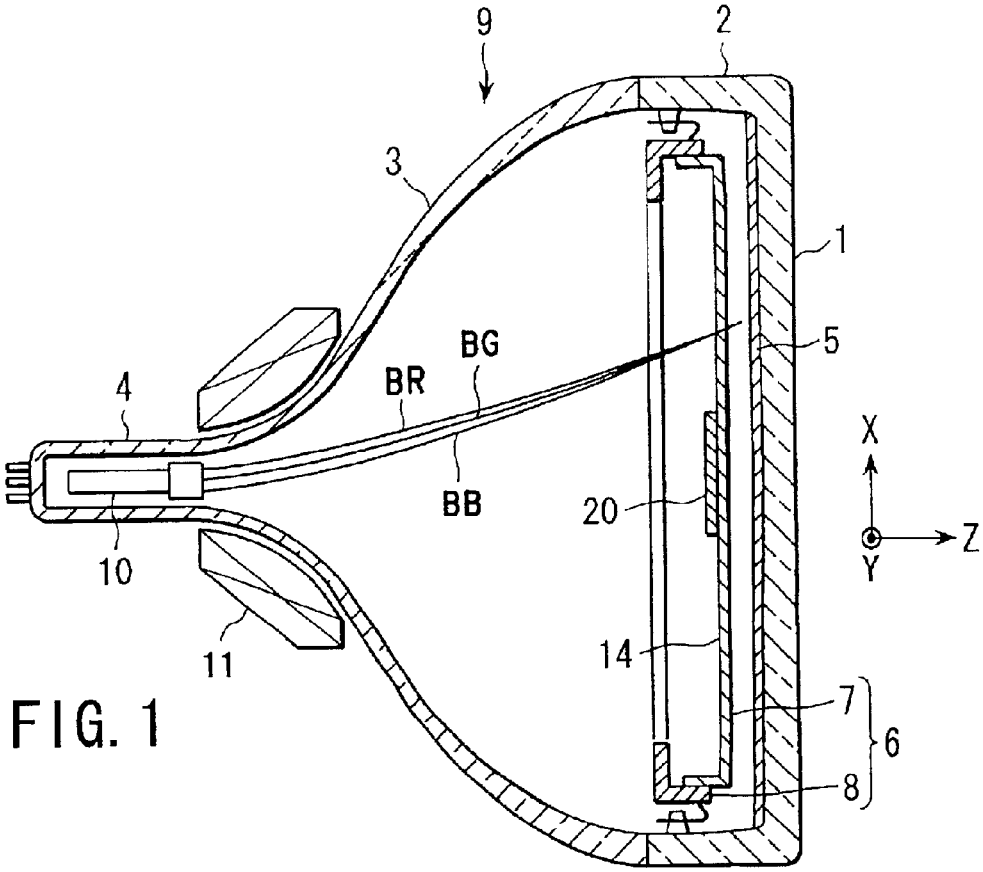
FIG. 1 is a sectional view containing the major axis of a color cathode ray tube according to an embodiment of the invention.
Figure 2:
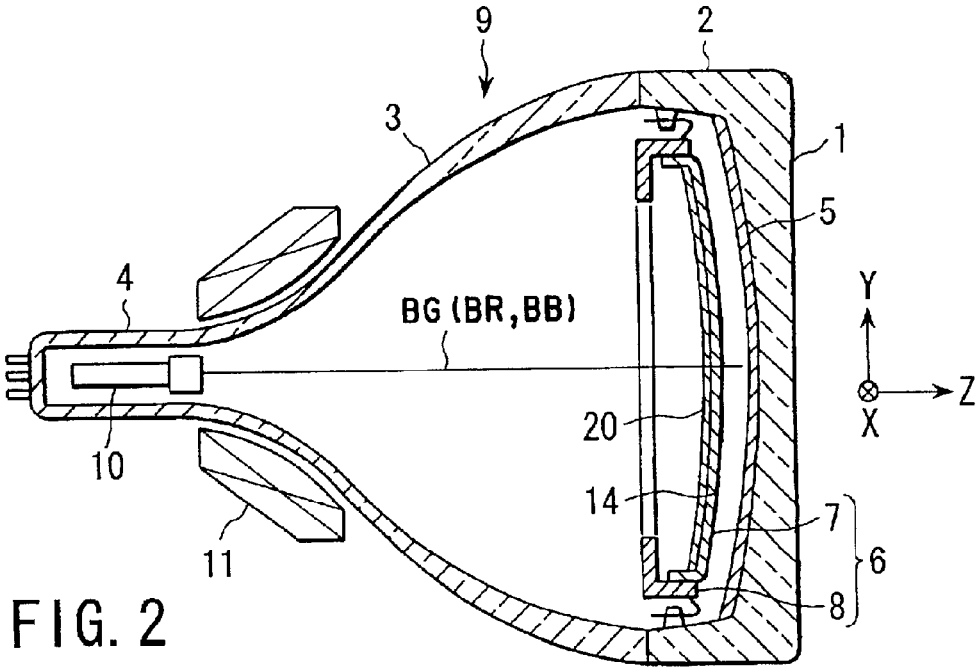
FIG. 2 is a sectional view containing the minor axis of the color cathode ray tube.

As shown in FIGS. 1 and 2, a color cathode ray tube comprises an envelope 9, which includes a rectangular panel 1, a funnel 3 bonded to a skirt portion 2 of the panel 1, and a neck 4 extending from the funnel 3. The panel 1 has its major axis extending in the horizontal-axis (X-axis) direction and its minor axis in the vertical-axis (Y-axis) direction. A phosphor screen 5 is formed on the inner surface of the panel 1. Further, a shadow mask assembly 6 that functions as a color-sorting electrode is located inside the panel 1.

The shadow mask assembly 6 includes a shadow mask 7 and a rectangular mask frame 8 having an L-shaped cross section. The shadow mask 7 is formed having a large number of apertures that serve as electron beam passage apertures. The periphery of the mask 7 is fixed to the mask frame 8. The shadow mask assembly 6 is supported inside the panel 1 in a manner such that elastic supports on the sidewalls of the frame 8 are engaged with stud pins that are set up on the skirt portion 2 of the panel 1.

Located in the neck 4 is an electron gun 10 that emits three electron beams BR, BG and BB arranged in line on the X-axis. Further, a deflection yoke 11 is mounted on the outside of the funnel 3. In the color cathode ray tube, the deflection yoke 11 deflects the electron beams BR, BG and BB that are emitted from the electron gun 10. An image is displayed as the phosphor screen 5 is scanned horizontally and vertically with the electron beams that are passed through the shadow mask assembly 6.

In the case of a 32-inch wide-type color cathode ray tube with an aspect ratio of 16:9 and an effective screen dimension of 76 cm, the outer surface of the panel 1 is substantially flat, having a curvature radius of 100,000 mm. The inner surface of the panel 1 is substantially cylindrical, having a curvature radius of about 7,000 mm on and along the X-axis and a curvature radius of about 1,500 mm on and along the minor axis Y.

As shown in FIGS. 3A to 7, the shadow mask 7 comprises a shadow mask body 14 in the shape of a predetermined curved surface and an auxiliary mask 20 fixed partially overlapping the shadow mask body. A hatched region in FIG. 3A indicates a double-structure portion in which the auxiliary mask 20 is fixed to the shadow mask body 14. Thus, the shadow mask of the present embodiment partially has a double structure. In this specification, a mask that has an effective portion corresponding to the whole area of the display screen is referred to as "shadow mask body 14," while a mask that is used to form the partial double structure is referred to as "auxiliary mask 20."

The shadow mask body 14 has a rectangular effective portion 13 that is formed having a large number of apertures 12 through which the electron beams are passed, and a non-effective portion 15 that surrounds the effective portion 13. The non-effective portion 15 is composed of an aperture-free portion 16 that has no apertures 12 and a skirt portion 17 that extends in the direction of a tube axis Z from the outer periphery of the aperture-free portion 16 in a bent manner.

Figure 3A:
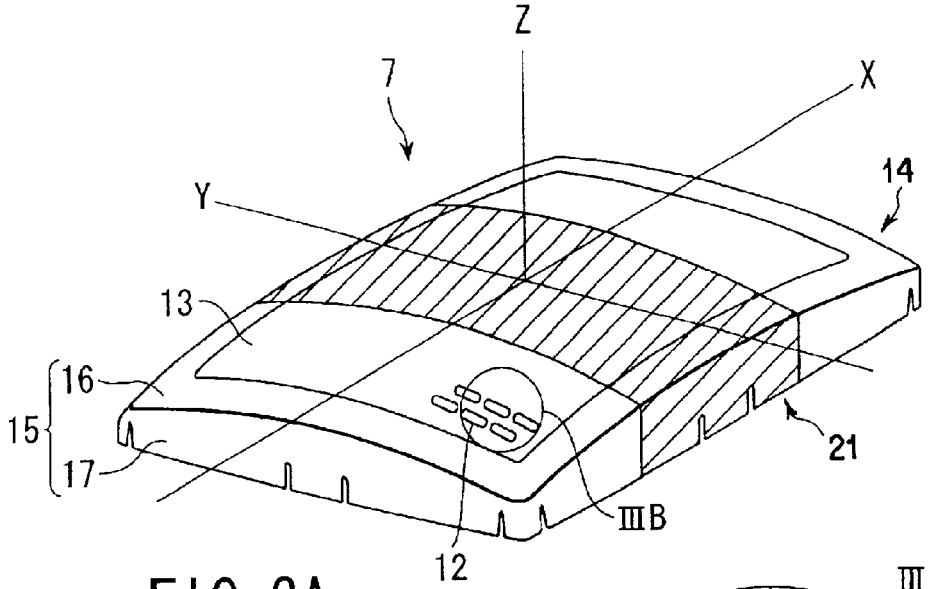
FIG. 3A is a perspective view schematically showing a shadow mask of the color cathode ray tube.
Figure 3B:
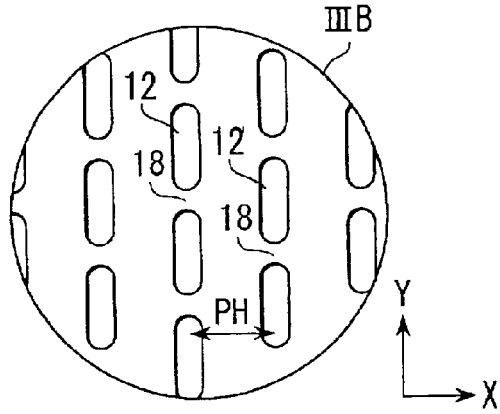
FIG. 3B is an enlarged plan view showing a portion IIIB of FIG. 3A.

In the shadow mask 7, each aperture 12 for use as an electron beam passage aperture is made to be rectangular or circular, according to the purpose of use. In the present embodiment, as shown in FIG. 3B, each aperture 12 of the shadow mask body 14 is substantially in the shape of a rectangle of which the width direction corresponds to the direction of the major axis X of the effective portion 13. The apertures 12 are arranged in a manner such that a number of straight aperture array, extending in the direction of the minor axis Y of the effective portion 13, are arranged at given pitches PH in the direction of the major axis X. Each aperture array includes a plurality of apertures 12 that are arranged straight in the direction of the minor axis Y with bridges 18 between them.

Figure 6:
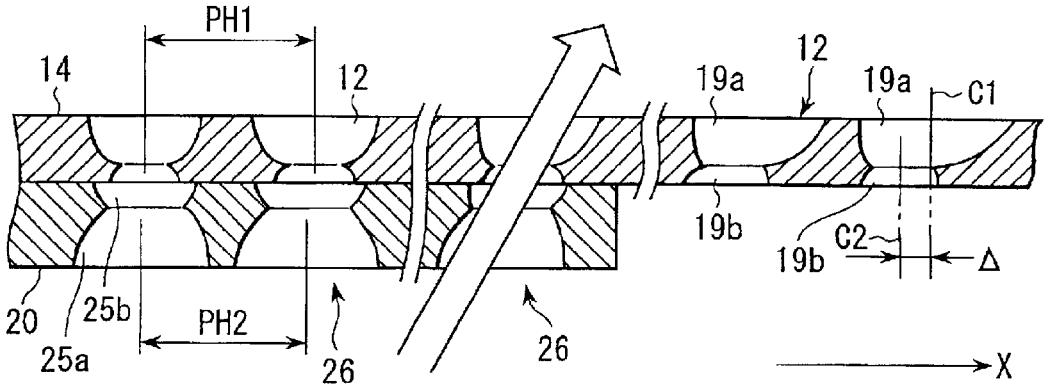
FIG. 6 is an enlarged sectional view showing a shadow mask body and an auxiliary mask that constitutes the shadow mask.

As shown in FIG. 6, each aperture 12 is a through hole that is formed of a substantially rectangular larger hole 19*a* and a substantially rectangular smaller hole 19*b*. The larger hole 19*a* opens on the side of the phosphor screen 5 of the shadow mask body 14, and the smaller hole 19*b* on the electron-gun side. In apertures 12 that are situated nearer to the periphery of the picture plane, a center C2 of the larger hole 19*a*, compared with a center C1 of the smaller hole 19*b*, is shifted with a greater eccentricity Δ on the peripheral side of the screen. This is done in order to restrain each electron beam having passed through the smaller hole 19*b* from running against and being reflected by the inner surface of the aperture 12, thereby causing unnecessary irradiation on the screen. The larger hole 19*a* is offset with respect to the smaller hole 19*b* in both the respective directions of the minor axis Y and the major axis X. Thus, the shadow mask is formed as a so-called off-center mask.

The shadow mask body 14 may be a structure with a thickness of about 0.1 to 0.25 mm that is formed of a steel material or a metallic material such as Invar (Fe-36% Ni alloy), a well-known low-expansion material.

Figure 4:
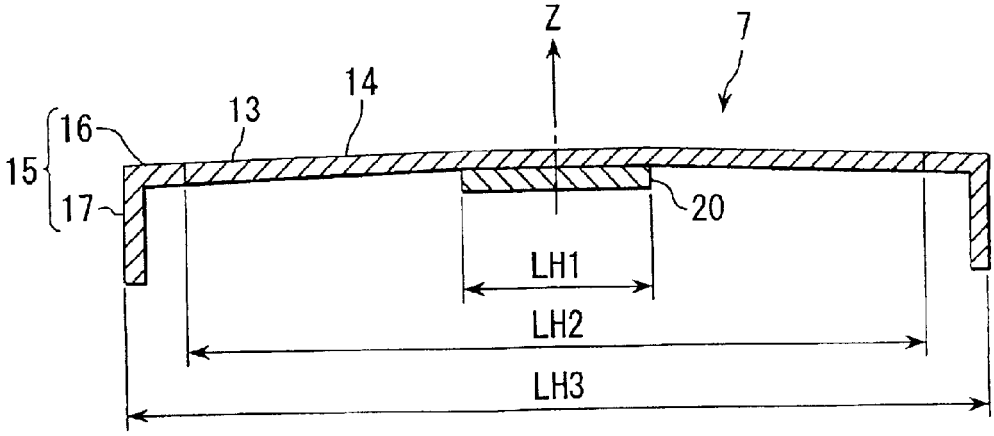
FIG. 4 is a sectional view taken along the major axis of the shadow mask.
Figure 5:
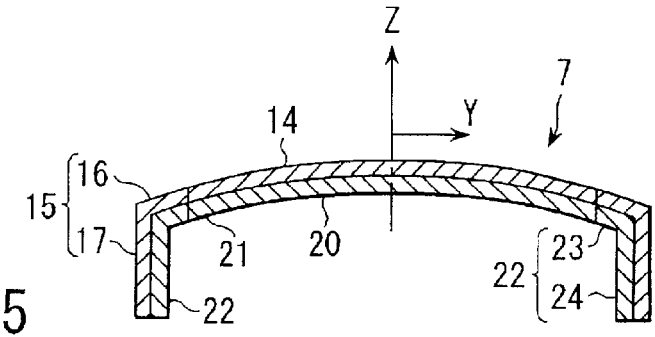
FIG. 5 is a sectional view taken along the minor axis of the shadow mask.

As shown in FIGS. 4 to 6, the auxiliary mask 20 is fixed to the electron-gun-side surface of the shadow mask body 14 so as to overlap a region that contains the minor axis Y, not the entire effective portion 13. The auxiliary mask 20 is in the form of a strip that is long in the direction of the minor axis Y. A width LH1 of the mask 20 in the X-axis direction is smaller than an X-direction dimension LH2 of the effective portion 13 of the shadow mask body 14, and an outside dimension LV1a in the direction of the minor axis Y is greater than a dimension LV2 of the effective portion of the shadow mask body 14 in the direction of the minor axis Y. Further, the auxiliary mask 20, like the shadow mask body 14, has an effective portion 21 that is provided with a large number of apertures 26 corresponding to the apertures 12 of the shadow mask body 14 and non-effective portions 22 that are situated individually on the opposite ends of the skirt portion 2 in the direction of the minor axis Y. The shadow mask 7 having the partial double structure is formed as the auxiliary mask 20 is superposed and fixed on the region that contains the minor axis Y.

As shown in FIG. 5, each non-effective portion 22 includes an aperture-free portion 23 continuous with the effective portion 21 and a skirt portion 24 extending from the aperture-free portion 23. With use of the skirt portion 24, the entire region of the shadow mask 7 on the minor axis Y has a double structure, which ensures better strength. Other advantages of the use of the skirt portion 24 will be mentioned later.

The following is a description of a specific configuration. The shadow mask body 14 is formed of Invar (Fe-36% Ni alloy) with a thickness of 0.18 mm. The effective portion 13 is a rectangular structure having the X-direction dimension LH2 of 622 mm and Y-direction dimension LV2 of 356 mm. The effective portion 13 is formed having a large number of straight aperture lines in which the apertures 12 are arranged at pitches of 0.6 mm in the direction of the minor axis Y with the bridges 18 between them. These aperture lines are arranged at variable pitches that become greater as the periphery in the major-axis direction is approached so that the X-direction pitches PH near the minor axis Y are 0.75 mm and the pitches PH near the periphery in the X-direction are 0.82 mm.

The X-direction dimension of the larger hole 19*a* is 0.46 mm on the minor axis Y and 0.50 mm in the X-direction peripheral portion. The X-direction dimension of the smaller hole 19*b* is 0.18 mm on the minor axis Y and 0.20 mm in the X-direction peripheral portion. If an electron beam are incident at an angle of 460 upon the apertures in the X-direction peripheral portion, the eccentricity Δ of the center C2 of the larger hole 19*a* with respect to the center C1 of the smaller hole 19*b* is 0.06 mm in the X-direction peripheral portion.

The auxiliary mask 20, like the shadow mask body 14, is formed of Invar (Fe-36% Ni alloy) with a thickness of 0.25 mm. The X-direction dimension LH1 of the effective portion 21 is 120 mm, the outside dimension LV1a of the auxiliary mask 20 in the direction of the minor axis Y is 381 mm, and a dimension LV1b of the effective portion 21 in the direction of the minor axis Y is 358 mm. Since an outside dimension LH3 of the shadow mask body 14 in the X-axis direction is 665 mm, the ratio between the X-direction dimension LH1 of the effective portion 21 of the auxiliary mask 20 (i.e., the width of the auxiliary mask) and the X-direction outside dimension LH3 of the shadow mask body is about 1:5. Thus, the auxiliary mask 20 covers a central portion of the shadow mask body 14 that occupies about ⅕ of the whole area of the shadow mask body, thereby forming a double structure.

The shape and arrangement pitch of the apertures 26 in the auxiliary mask 20 can be suitably set as long as the mask 20 can function as a shadow mask. If there is no special problem, they may be set in the same manner with those of the shadow mask body 14.

The shadow mask 7 is thus formed partially having the double structure on account of the result of the following examination conducted by the inventors hereof.

The inventors hereof examined the relation between the curved configuration and mechanical strength of the shadow mask by simulation. Thereupon, an intermediate portion that contains the minor axis Y of the shadow mask was found to be low in strength. More specifically, when a certain load was applied to the whole area of the shadow mask, the displacement of the shadow mask was greater in the central part of the effective portion and smaller in the peripheral part of the effective portion. Thus, the strength of the shadow mask was lower in the central part of the effective portion and higher in the peripheral part of the effective portion. It was found that the intermediate portion between the mask center and the periphery was particularly fragile on the minor axis Y of the effective portion.

The strength of the peripheral part of the effective portion of the shadow mask is thus increased because the peripheral part of the effective portion is bent to form the skirt portion that is fixed to the mask frame by welding. The strength of the central part of the effective portion is low because the central part of the effective portion that determines the image quality level has no bent structure. Accordingly, the inventors hereof tried to improve the strength by providing the shadow mask with a partial double structure, not a bent structure, thereby partially increasing the substantial thickness of the shadow mask.

The mechanical strength can be improved further favorably by enlarging the area of the auxiliary mask 20 to a degree such that it covers the entire effective portion of the shadow mask body 14. In this case, however, the accuracy of position alignment cannot be ensured.

If the respective apertures 12 and 26 of the shadow mask body 14 and the auxiliary mask 20 are not aligned with one another when the auxiliary mask 20 is fixed to the effective portion 13 of the shadow mask body 14, the shadow mask 7 cannot function satisfactorily. If the area of the auxiliary mask 20 increases, the number of apertures 12 to be aligned within the range of the area increases. Thus, it is hard to finely adjust the positions of the mask aperture lines and secure accuracy against the dislocation of the apertures in the direction of the minor axis Y.

Figure 8:
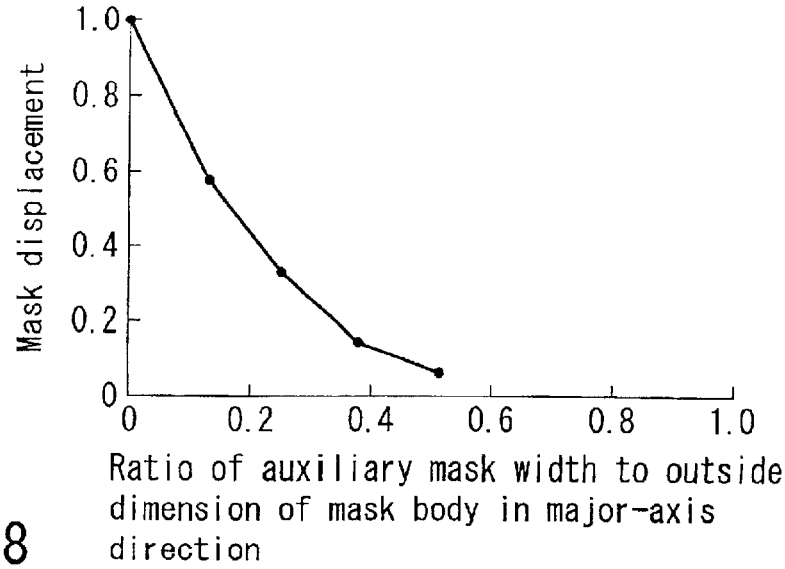
FIG. 8 shows a characteristic curve representing the relation between the width of the auxiliary mask and shadow mask displacement.

Accordingly, the inventors hereof further examined the width of the auxiliary mask 20 and the mask strength. FIG. 8 shows the result of this examination. FIG. 8 is a graph showing the relation between the width of the auxiliary mask and the mask displacement in the case of the 32-inch color cathode ray tube. In FIG. 8, the axis of abscissa represents the ratio of the width (LH1) of the auxiliary mask 20 to the X-direction outside dimension LH3 of the shadow mask body 14. The ordinate axis represents the maximum mask displacement that is 0 when the width LH1 of the auxiliary mask 20 is increased to the X-direction outside dimension LH3 of the shadow mask body 14 and is 1 when no auxiliary mask is used.

As seen from FIG. 8, the maximum displacement of the auxiliary mask 20 decreases as its width LH1 is increased. If the width LH1 of the auxiliary mask 20 becomes equal to about ⅓ of the outside dimension LH3 of the shadow mask body 14, however, the change of the maximum displacement is slowed down. Thereafter, no substantial change is seen.

If the width LH1 of the auxiliary mask 20 is increased, on the other hand, the area of the mask 20 increases, leading to difficulty in accurate position alignment. It was confirmed, however, that satisfactory accuracy for position alignment can be secured if the width LH1 of the mask 20 is within ⅓ of the outside dimension LH3 of the shadow mask body 14.

Based on this examination result, it is to be desired that the auxiliary mask 20 should be fixed to the central portion of the shadow mask body 14 for a width equal to about ⅓ of the outside dimension LH3 of the shadow mask body in the direction of the major axis.

The auxiliary mask 20 may be divided into a plurality of pieces without deviating from the aforesaid range. If a plurality of auxiliary masks are used, they require additional steps of a fixing operation. Since the number of apertures in each auxiliary mask is reduced, however, the position alignment accuracy can be improved, and a cut in the required time for position alignment can be expected.

The following is a description of several elements that are associated with the auxiliary mask 20.

Figure 7:
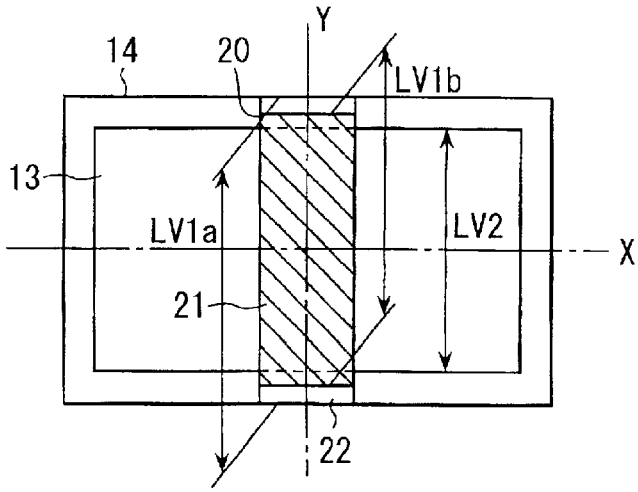
FIG. 7 is a plan view showing the relation between the respective effective dimensions of the shadow mask body and the auxiliary mask.

FIG. 7 shows the dimensions of the effective portion 21 of the auxiliary mask 20 compared with those of the shadow mask body 14. Preferably, as shown in FIG. 7, the dimension LV1b of the effective portion 21 in the direction of the minor axis Y is set to be equal to or a little greater than the dimension LV2 of the effective portion 13 of the shadow mask body 14 in the direction of the minor axis Y.

Let it be supposed that the respective effective portions of the auxiliary mask 20 and the shadow mask body 14 are adjusted to the same Y-direction dimension. If dislocation in the direction of the minor axis Y occurs when the mask 20 is fixed to the shadow mask body 14, in this case, the substantial effective dimension in superposed regions is reduced by a margin corresponding to the dislocation. If the substantial effective dimension in the superposed regions of the shadow mask 7 is reduced, differences in level are inevitably created on the long side of the screen at the boundaries between the superposed regions and non-superposed regions, so that the resulting picture is very unsightly. Thus, the continuity of the effective portion of the shadow mask 7, that is, the linearity of the outlines of the rectangular effective portion, influences the continuity (linearity) of the phosphor screen 5. The Y-direction dimension of the superposed regions is settled by the apertures of the two masks 14 and 20, that are located the outermost portions of the electron beam passage aperture areas in the superposed regions and superposed to each other. Accordingly, the Y-direction dimension of the superposed regions is expected to be continuous with the Y-direction dimension of the effective portion in the adjacent non-superposed regions.

In the case where the Y-direction dimension of the effective portion of the shadow mask body 14 in the superposed regions is different from that of the auxiliary mask 20, the substantial dimension of the effective portion in the non-superposed regions, on the long side of the screen, can be continuously connected to that in the superposed regions if dislocation in the direction of the minor axis Y is caused between the masks 14 and 20. Thus, differences in level on the long side of the screen can be prevented from being caused.

There are two methods for changing the Y-direction effective dimension in the superposed regions. One is based on a countermeasure provided on the shadow mask body 14, and the other on the auxiliary mask 20. The pattern design of the shadow mask body 14 must be changed in order to partially change the dimension of the effective portion of the shadow mask body in the region where the auxiliary mask 20 is fixed. Possibly, moreover, the dimension of the effective portion may be subject to differences in level unless the auxiliary mask is accurately located in the region where the effective dimension is changed.

According to the other method, a large number of apertures are previously formed in the same rectangular region of the shadow mask body 14 as the conventional one, and the dimension of the effective portion of the auxiliary mask 20 in the direction of the minor axis Y is adjusted to a large value. In this case, the respective aperture patterns of the two masks can be designed with ease, and the subsequent position alignment is easy.

For this reason, the latter method is preferred to the former. In the embodiment described above, the dimension LV2 of the effective portion of the shadow mask body 14 in the direction of the minor axis Y in the superposed regions where the auxiliary mask 20 overlaps the shadow mask body 14 is made equal to the Y-direction dimension of the effective portion in the non-superposed regions. Further, the dimension LV1b of the effective portion of the auxiliary mask 20 in the direction of the minor axis Y is adjusted to a value a little greater than the dimension LV2 of the effective portion of the shadow mask body 14, whereby misalignment is absorbed.

Preferably, the auxiliary mask 20 should be formed of a material that has a coefficient of thermal expansion similar to that of the material of the shadow mask body 14. Ideally, the two masks should be formed of materials that have the same coefficient of thermal expansion. This is because the influence of heat treatment must be taken into account, since the shadow mask 7 is subjected to heat of about 400° C. during the manufacture of the color cathode ray tube. If the shadow mask body 14 and the auxiliary mask 20 have considerably different coefficients of thermal expansion, a portion on which the auxiliary mask 20 is stuck becomes bimetallic. Thus, the heat-treated shadow mask 7 may be deformed or, if not, become unstable in shape.

The shadow mask 7 that has a curved surface with a short radius of curvature, as in the perfectly flat tube of the present embodiment, suffers a distinguished color drift that is attributable to thermal expansion. Preferably, a shadow mask that is formed of a material with a low coefficient of thermal expansion, such as Fe—Ni alloy, Fe—Ni—Co alloy, or Fe—Ni—Cr alloy, should be used for the shadow mask that easily undergoes a color drift owing to its shape.

For this reason, according to the embodiment described above, Invar is used for both the shadow mask body 14 and the auxiliary mask 20.

Since the apertures of the shadow mask are formed by etching, the thickness of the mask should be reduced to ensure a high-precision configuration. Since the angle of incidence of each electron beam on the shadow mask is wider in the peripheral portion of the screen, moreover, the electron beam is liable to run against the inner surface of each aperture. If the electron beam is reflected by the inner surface of each aperture, unnecessary irradiation is caused. If the electron beam is intercepted by the inner surface of the aperture, furthermore, shading of a beam spot called an "eclipse" is caused on the phosphor screen. The thicker the shadow mask, the easier the beam reflection and eclipse occur. In order to restrain the occurrence of these phenomena also, the shadow mask should preferably be thinner. Thus, in consideration of the fact that the strength of the shadow mask 7 can be improved by means of the auxiliary mask 20, the shadow mask body 14, which has an effective portion 13 corresponding to the whole area of the screen, should be thinned to ensure a high-precision configuration.

On the other hand, the auxiliary mask 20 is a member that is intended for the improvement of the strength of the shadow mask 7, so that it should preferably be thick. The aforesaid eclipse and the etching properties of the apertures are problems to the increase of the thickness. Since the auxiliary mask 20 is located near the minor axis Y of the shadow mask body, however, the angle of beam deflection in the direction of the major axis X of the electron beams incident upon the auxiliary mask is narrow enough to avoid the eclipse. If a thick mask is etched, the diameter of the apertures is large. In the auxiliary mask 20, as mentioned later, the aperture diameter in the major-axis direction of the shadow mask body can be increased. Thus, increasing the thickness of the auxiliary mask 20 arouses no special problem.

For this reason, the strength of the shadow mask can be secured by relatively thinning the shadow mask body 14 to realize a high-precision configuration and making the thickness of the auxiliary mask 20 equal to or thicker than the shadow mask body 14.

At the junction of the auxiliary mask 20 and the shadow mask body 14, as shown in FIG. 6, the surface of the mask 20 on the side of smaller holes 25*b* and the surface of the mask body 14 on the side of the smaller holes 19*b* are in intimate contact with each other.

Accordingly, the area of contact between the shadow mask body 14 and the auxiliary mask 20 is wider than in the case where the smaller holes 19*b* of the mask body 14 and their corresponding larger holes 25*a* of the mask 20 are in contact with one another. Thus, the two masks can be fixed firmly and securely to each other.

Normally, the shadow mask body 14 is provided with the smaller holes 19*b* on its electron-gun-side surface. In the embodiment described above, therefore, the auxiliary mask 20 is located on the electron-gun side of the mask body 14 in order that it can be fixed securely and easily. Preferably, in the auxiliary mask 20, each aperture 26 should be also formed in a manner such that the center of the smaller hole 25*b* on the phosphor-screen side is shifted with eccentricity to the center of the electron-gun-side larger hole 25*a* on the peripheral side of the shadow mask.

Each aperture 26 of the auxiliary mask 20 is formed having an X-direction diameter larger than that of its corresponding aperture 12 of the shadow mask body 14. This is done in order to make an allowance for dislocation, if any, between the shadow mask body 14 and the auxiliary mask 20. With respect to the direction of the minor axis Y also, the dimension (not shown) of each aperture 26 of the auxiliary mask 20 should preferably be greater than that of each aperture 12 of the shadow mask body 14. With respect to the minor-axis direction, however, the width of each bridge 18 of the shadow mask body 14 is restricted to a substantially minimum possible value for manufacture in order to improve the brightness of the phosphor screen. Thus, the respective Y-direction diameters of the apertures of the auxiliary mask 20 and the shadow mask body 14 may be identical.

Let it be supposed that the pitches of the aperture lines in the peripheral region of the auxiliary mask 20 are based on aperture positions as averages of the positions of the respective centers of the larger and smaller holes. Based on the comparison between the corresponding aperture lines of the shadow mask body 14 and the auxiliary mask 20, it is to be desired that an aperture line pitch PH2 of the mask 20 should be shorter than an aperture line pitch PH1 of the mask body 14, as shown in FIG. 6.

In the superposed regions of the shadow mask body 14 and the auxiliary mask 20, the electron beams pass through the two masks. If the angle of incidence of the electron beams is wide, as in the case of incidence upon the X-direction end portions of the auxiliary mask, therefore, the X-direction displacement of the electron beams within the mask thickness is substantial. If the aperture line pitch PH2 of the auxiliary mask 20 is made shorter than the aperture line pitch PH1 of the shadow mask body 14, the respective positions of the apertures 12 and 26 of the mask body 14 and the mask 20 can be aligned with the electron beam trajectories, so that the occurrence of eclipses of the electron beams or the like can be restrained.

If the respective dimensions of the apertures of the shadow mask body and the auxiliary mask in the direction of the minor axis Y of the shadow mask are substantially equal, the aperture pitch of the auxiliary mask should preferably be made shorter than that of the shadow mask body.

The aperture diameter along the minor axis Y of the effective portion of one of the two masks, the shadow mask body 14 and the auxiliary mask 20, is made twice or more as large as that of the other mask, and each aperture of the one mask is opposed to a bridge that is located between each two adjacent apertures of the other mask. Thereupon, the space between the apertures in the non-superposed regions through which the electron beams pass is equal to the space between the apertures in the superposed regions, so that the influence of the positional accuracy of the apertures can be lessened.

Figure 9A:
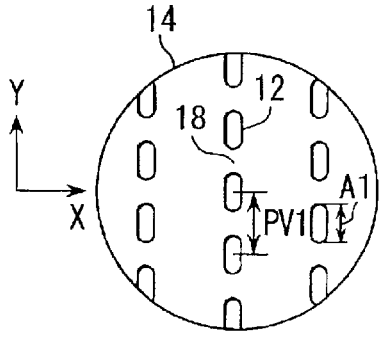
FIG. 9A is a plan view showing an aperture array of the shadow mask body.
Figure 9B:
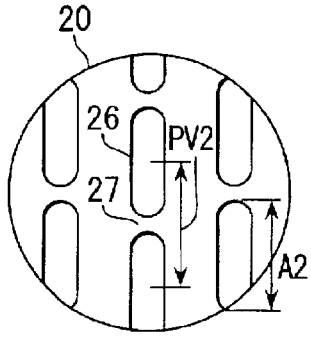
FIG. 9B is a plan view showing an aperture array of the auxiliary mask.

By way of example, the non-superposed regions and the superposed regions of the shadow mask body 14 are previously formed having the aperture lines that are composed of the apertures 12 and the bridges 18, as shown in FIG. 9A. As shown in FIG. 9B, moreover, a diameter A2 of each aperture 26 of the auxiliary mask 20 in the direction of the minor axis Y is made twice or more as large as a diameter A1 of each aperture 12 of the shadow mask body 14 in the direction of the minor axis Y, and an aperture space PV2 in the minor-axis direction is made to double an aperture space PV1 of the shadow mask body 14.

Figure 9C:
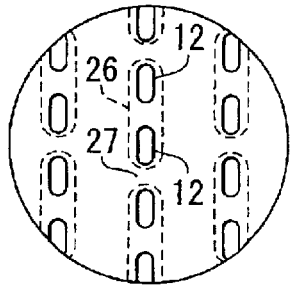
FIG. 9C is a plan view showing the way the respective apertures of the shadow mask body and the auxiliary mask are superposed on one another.

If the shadow mask body 14 and the auxiliary mask 20 are joined so that their respective bridges 18 and 27 are aligned with one another, the number of the respective bridges of the two masks that overlap one another can be reduced, as shown in FIG. 9C. Thus, the number of portions that require position alignment between the shadow mask body 14 and the auxiliary mask 20 is reduced, so that the influence of the accuracy of position alignment can be lessened.

Figure 10A:
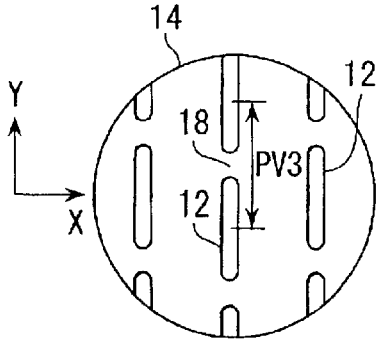
FIG. 10A is a plan view showing another example of the aperture array of the shadow mask body.
Figure 10B:
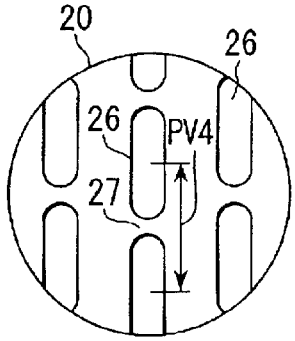
FIG. 10B is a plan view showing another example of the aperture array of the auxiliary mask.

In another arrangement, as shown in FIG. 10A, a Y-direction space PV3 between the apertures 12 in the superposed regions of the shadow mask body 14 to which the auxiliary mask 20 is fixed is set to be twice as large as the Y-direction space PV1 (see FIG. 9A) between the apertures 12 in the non-superposed regions of the shadow mask body 14 to which the auxiliary mask 20 is not fixed. As shown in FIG. 10B, moreover, a Y-direction space PV4 between the apertures 26 of the auxiliary mask 20 is set to be twice as large as the aperture space PV1 in the non-superposed regions of the shadow mask body 14, and the position of each bridge 27 of the auxiliary mask 20 is shifted by a ½ pitch in the direction of the minor axis Y with respect to the position of each corresponding bridge 18 of the mask body 14.

Figure 10C:
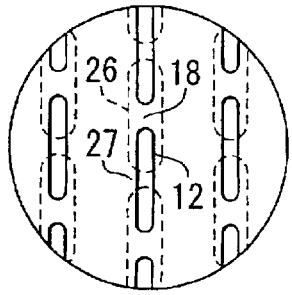
FIG. 10C is a plan view showing another example of the way the respective apertures of the shadow mask body and the auxiliary mask are superposed on one another.

In the superposed regions that are formed as the auxiliary mask 20 is fixed to the shadow mask body 14, according to this arrangement, the apertures 12 and 26 are divided by the bridges 18 and 27, as shown in FIG. 10C, so that the same aperture space in the non-superposed regions shown in FIG. 9A can be enjoyed. With use of the construction described above, moreover, deviations between the aperture spaces in the superposed regions can be lessened, so that the allowance for the dislocation of the apertures of the masks can be increased. In consequence, the yield of production can be improved.

The shadow mask 7 described above is manufactured in the following manner.

Figure 11:
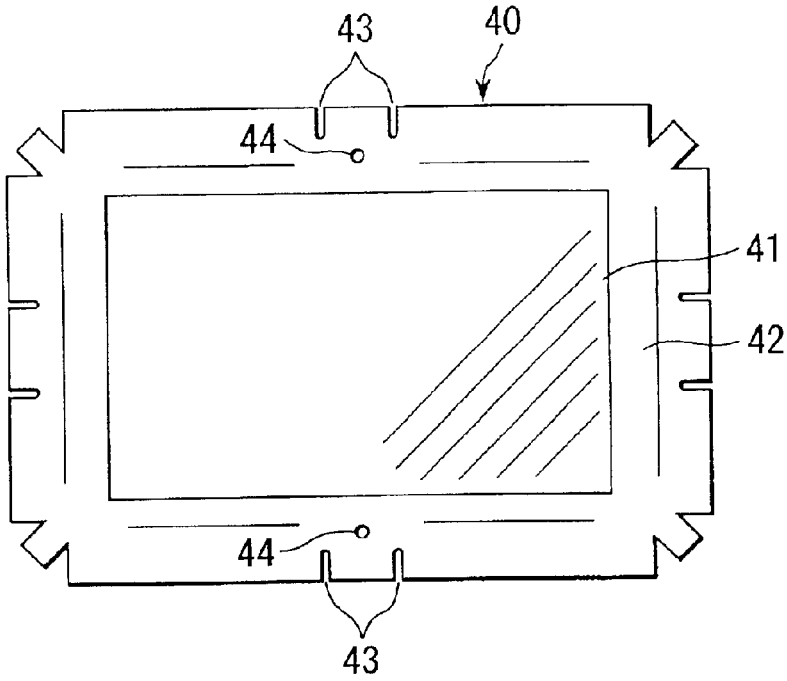
FIG. 11 is a plan view showing the shadow mask body prior to press forming.
Figure 12:
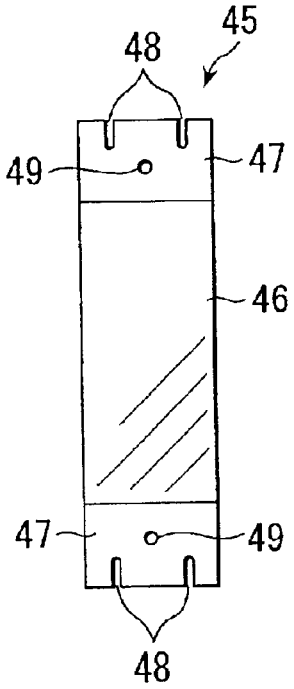
FIG. 12 is a plan view showing the auxiliary mask prior to press forming.

First, a flat shadow mask body blank 40 and an auxiliary mask blank 45 are prepared each having given outside dimensions and apertures with a given dimension, as shown in FIGS. 11 and 12. Each blank is formed by etching a metal sheet. The blanks 40 and 45 have their respective effective portions 41 and 46 and peripheral non-effective portions 42 and 47. The effective portions 41 and 46 are formed having a large number of apertures as electron beam passage apertures. The non-effective portions 42 and 47 have their respective notches 43 and 48 and positioning holes 44 and 49.

The positioning holes 44 and 49 serve to accurately position and fix the blanks 40 and 45. In some cases, the apertures in the effective portions 41 and 46 may be staggered or formed having different diameters. It is hard, therefore, to settle the respective positions of the blanks 40 and 45 with reference to the apertures of the effective portions 41 and 46. In this case, the shadow mask body blank 40 and the auxiliary mask blank 45 can be positioned securely and easily by means of the positioning holes 44 and 49 that are situated in given positions in the blanks 40 and 45. This positioning method is also an effective method for the case where the offset of the aperture positions is minor.

The flat blanks 40 and 45 are superposed on each other after they are annealed to be improved in adaptability to press forming. The superposing operation is easy if the auxiliary mask blank 45 is formed having a portion to serve as a skirt portion like that of the shadow mask body blank 40. The skirt portion of the blank 40 is provided with a plurality of notches 43 and a fixing portion for fixation to the mask frame. If the blank 45 is also provided with the skirt portion and the similar notches 48, the notches 43 and 48 can be used as references for temporary position alignment. Rough positioning can be achieved if the blanks 40 and 45 are stacked on a jig with reference to the notches 43 and 48, for example.

Figure 13:
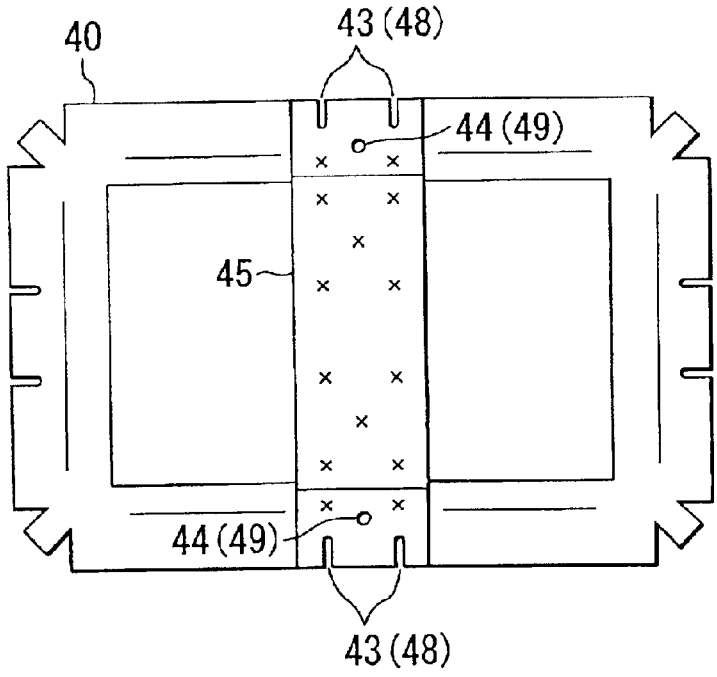
FIG. 13 is a plan view showing the shadow mask body of FIG. 11 and the auxiliary mask of FIG. 12 fixed to each other.

As shown in FIG. 13, thereafter, the blanks 40 and 45 are accurately aligned with each other with reference to the positioning holes 44 and 49. If the positioning holes 44 and 49 are not provided, the relative positions of the blanks 40 and 45 are adjusted by means of the apertures in the effective portions 41 and 46. After the positioning, the blanks 40 and 45 are adhered and fixed to each other. Preferably, in this case, the blanks 40 and 45 should be fixed in a manner such that their respective entire effective portions are in intimate contact with each other. Diffused bonding, called a press bonding, or laser or resistance welding may be used for the fixation. In the welding operation, at least several weld beads (indicated by crosses in FIG. 13) are formed in the effective portion 46 of the auxiliary mask blank 45.

Laser welding is the most practical method for fixing the blanks 40 and 45. In the case of diffused boding, the two blanks must be subjected to high temperature and high pressure, entailing special equipment, which raises the cost. Welding is favorable in view of cost performance. If the diameter of weld nuggets increases, however, the nuggets may possibly cause apertures in the blanks to be deformed, that is, to be partially narrowed or widened. If this deformation occurs, black spots like stains or high-luminance white spots are formed on the phosphor screen, constituting drawbacks on the picture plane. Thus, laser welding which minimizes the weld nugget diameter, is the most practical method.

Preferably, weld beams should be also provided on the non-effective portions of the shadow mask body 14, including the aperture-free portion and skirt portion.

If this is done, a wider region can enjoy a falsely increased thickness, so that the mask strength can be improved.

Figure 14:
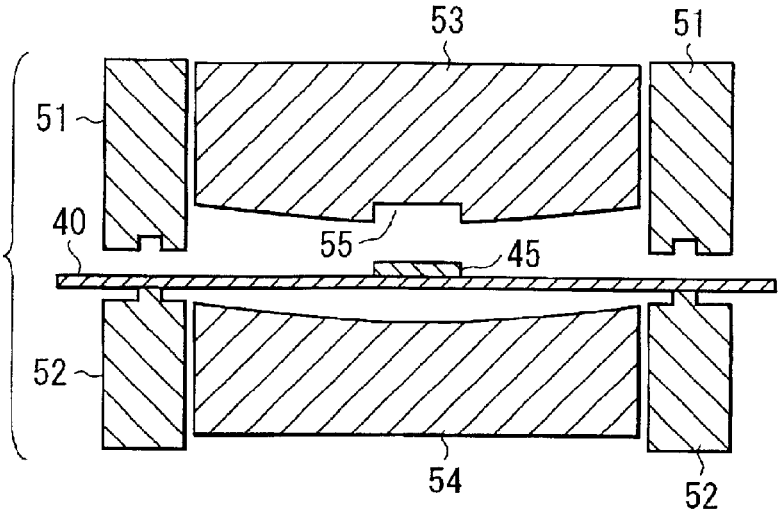
FIG. 14 is a sectional view showing a pressing apparatus and the shadow mask set in the pressing apparatus.

Then, the joined blanks 40 and 45 are press-formed simultaneously. FIG. 14 shows an example of a press tool 50 for press forming. The illustrated example is a press tool that is used in the case where an auxiliary mask is fixed to the electron-gun-side surface of a shadow mask body. The basic configuration of the tool 50 is identical with that of a conventional press tool. The tool 50 comprises a blank holder 51 and a die 52 for holding the non-effective portion of the blank 40 and a punch 53 and a knockout 54 that have their respective curved surfaces for drawing the blanks 40 and 45.

In the tool 50 for press-forming the shadow mask of the present embodiment, the punch 53 is somewhat different from a conventional one in shape. The surface of the punch 53 is formed having a recess 55 that is wide and deep enough to hold the auxiliary mask blank 45 therein. The presence of the recess 55 serves to prevent creation of differences in level on the boundaries between the superposed and non-superposed regions of the press-formed shadow mask 7.

In the present embodiment, the blanks 40 and 45 are press-formed after they are fixed to each other in a flat state, in order to secure the positional accuracy of the apertures. As mentioned before, the respective positions of the apertures of the blanks 40 and 45 must be exactly aligned with one another. If an attempt is made to align the aperture positions of the blanks 40 and 45 after the respective curved surfaces of the blanks 40 and 45 are formed, the occurrence of any dislocation during the press forming operation results in deviation in the aperture positions. It is hard, therefore, to align the apertures of the blanks 40 and 45. Since the blanks 40 and 45 are curved after they are press-formed, it is very hard to align their positions.

According to the present embodiment, therefore, the blanks 40 and 45 are positioned and fixed in a flat state before they are press-formed. After the press forming, as in the case of the manufacture of a conventional color cathode ray tube, the shadow mask 7 is subjected to mask-blacking treatment for forming an oxide film thereon and is then fixed to the mask frame.

According to a color cathode ray tube constructed in this manner, the strength of the shadow mask can be improved without lowering the yield of production or causing uneven display. Thus, the resulting color cathode ray tube can enjoy an improved image quality level.

Figure 15:
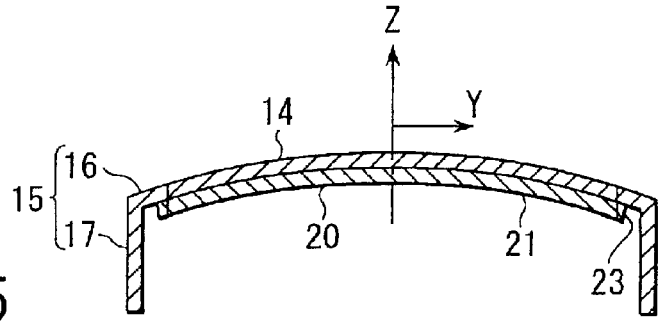
FIG. 15 is a sectional view showing a shadow mask according to another embodiment of the invention.

According to the embodiment described above, the auxiliary mask 20 has a skirt portion. Alternatively, however, an auxiliary mask 20 may be formed without a skirt portion, as shown in FIG. 15. FIG. 15 illustrates the profile of a shadow mask in comparison with the one shown in FIG. 5. Like reference numerals are used to designate corresponding portions in FIGS. 5 and 15.

Figure 16:
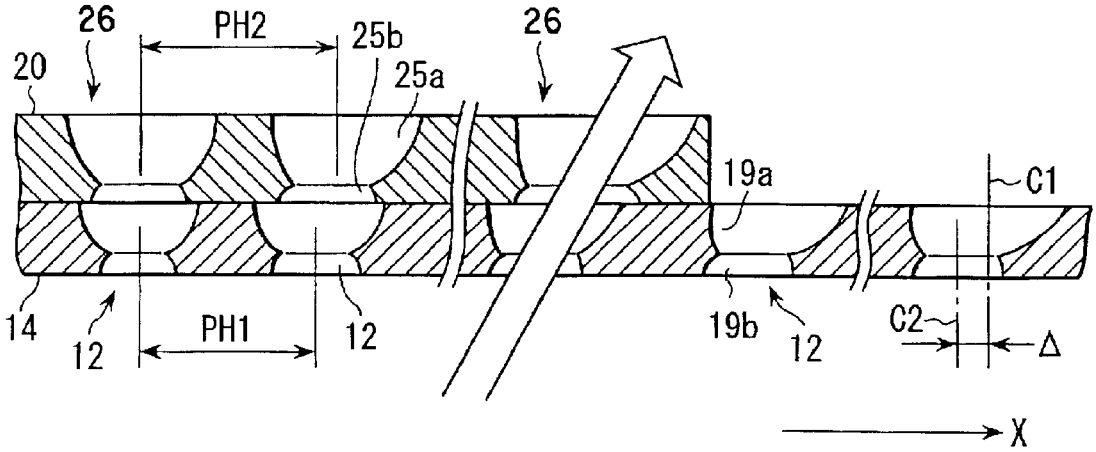
FIG. 16 is a sectional view showing the body of a shadow mask and an auxiliary mask according to still another embodiment of the invention.

As shown in FIG. 16, moreover, an auxiliary mask 20 may be located on the phosphor-screen side of a shadow mask body 14. In this case, the auxiliary mask 20 is fixed to the shadow mask body 14 in a manner such that larger holes 19*a* of the mask body 14 and smaller holes 25*b* of the mask 20 are in contact with one another. Further, the X-direction aperture pitch PH2 of the auxiliary mask 20 is set to be longer than the X-direction aperture pitch PH1 of the shadow mask body 14 lest electron beams be intercepted by the respective inner surfaces of apertures 12 and 34. For other particulars on the relative positions of the apertures, the same effect can be obtained if the configuration of the foregoing embodiment is suitably modified contrariwise.

Furthermore, although the shadow mask described above has rectangular apertures, the present invention may also be effectively applied to a shadow mask that has circular apertures.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

a panel provided with a phosphor screen;

an electron gun for emitting an electron beam toward the phosphor screen; and a shadow mask assembly located between the phosphor screen and the electron gun, the shadow mask assembly including a shadow mask body having a rectangular effective portion opposed to the phosphor screen and formed having a large number of electron beam passage apertures, the effective portion having a major axis and a minor axis passing through the center thereof and extending at right angles to each other, a mask frame to which the periphery of the shadow mask body is fixed, and an auxiliary mask in the form of a strip extending in the direction of the minor axis, fixed to a region having a width within ⅓ of the length of the shadow mask body in the direction of the major axis and situated in a longitudinal central region of the effective portion containing the minor axis, and having a number of electron beam passage apertures communicating individually with the electron beam passage apertures of the effective portion.

2. A color cathode ray tube according to claim 1, wherein said auxiliary mask has a central axis extending in the longitudinal direction thereof and is located in a manner such that the central axis overlaps the minor axis of the shadow mask body.

3. A color cathode ray tube according to claim 1, wherein said auxiliary mask is in the form of a strip having a lengthwise dimension greater than the length of the effective portion of the shadow mask body in the direction of the minor axis and a crosswise dimension smaller than the length of the effective portion in the direction of the major axis.

4. A color cathode ray tube according to claim 3, wherein said shadow mask body has a skirt portion provided around the effective portion and bent along a tube axis, and said auxiliary mask has an effective portion formed having the electron beam passage apertures and non-effective portions provided individually at the opposite ends of the effective portion with respect to the direction of the minor axis, the non-effective portions of the auxiliary mask being bent so as to be superposed on the skirt portion and fixed to the skirt portion.

5. A color cathode ray tube according to claim 4, wherein the length of the effective portion of said auxiliary mask in a longitudinal direction thereof is greater than the length of the effective portion of the shadow mask body in the direction of the minor axis.

6. A color cathode ray tube according to claim 1, wherein said auxiliary mask is formed of a material having a coefficient of thermal expansion substantially equal to that of the material of the shadow mask body.

7. A color cathode ray tube according to claim 1, wherein said auxiliary mask has a thickness equal to or greater than that of the shadow mask body.

8. A color cathode ray tube according to claim 1, wherein each electron beam passage aperture of the auxiliary mask has an aperture diameter larger than that of each electron beam passage aperture of the shadow mask body with respect to at least one of the respective directions of the major and minor axes.

9. A color cathode ray tube according to claim 1, wherein said auxiliary mask is provided on the electron-gun side of the shadow mask body, and the space between the electron beam passage apertures of said auxiliary mask is smaller than the space between the electron beam passage apertures of the shadow mask body with respect to at least one of the respective directions of the major and minor axes.

10. A color cathode ray tube according to claim 9, wherein each electron beam passage aperture of the shadow mask body is formed of a larger hole opening on the phosphor-screen side and a smaller hole opening on the electron-gun side, and each electron beam passage aperture of the auxiliary mask is formed of a smaller hole opening on the phosphor-screen side and a larger hole opening on the electron-gun side.

11. A color cathode ray tube according to claim 1, wherein said auxiliary mask is provided on the phosphor-screen side of the shadow mask body, and the space between the electron beam passage apertures of said auxiliary mask is greater than the space between the electron beam passage apertures of the shadow mask body with respect to at least one of the respective directions of the major and minor axes.

12. A color cathode ray tube according to claim 11, wherein each electron beam passage aperture of the shadow mask body is formed of a larger hole opening on the phosphor-screen side, and a smaller hole opening on the electron-gun side, and each electron beam passage aperture of the auxiliary mask is formed of a larger hole opening on the phosphor-screen side and a smaller hole opening on the electron-gun side.

13. A color cathode rate tube comprising:

a panel provided with a phosphor screen;

an electron gun for emitting an electron beam toward the phosphor screen; and a shadow mask assembly located between the phosphor screen and the electron gun, the shadow mask assembly including, a shadow mask body having a rectangular effective portion opposed to the phosphor screen, the effective portion having a major axis and a minor axis passing through the center thereof and extending at right angles to each other and having a large number of electron beam passage apertures, a mask frame to which the periphery of the shadow mask body is fixed, and an auxiliary mask in the form of a strip extending in the direction of the minor axis, being fixed to a region containing the minor axis of the effective portion, having a number of electron beam passage apertures communicating individually with the electron beam passage apertures of the effective portion, and having a crosswise dimension smaller than a length of the effective portion in the direction of the major axis.

14. A color cathode ray tube comprising:

a panel provided with a phosphor screen;

an electron gun for emitting an electron beam toward the phosphor screen; and a shadow mask assembly located between the phosphor screen and the electron gun, the shadow mask assembly including a shadow mask body having a rectangular effective portion opposed to the phosphor screen and formed having a large number of electron beam passage apertures, the effective portion having a major axis and a minor axis passing through the center thereof and extending at right angles to each other, a mask frame to which the periphery of the shadow mask body is fixed, and an auxiliary mask in the form of a strip extending in the direction of the minor axis, fixed to a region containing the minor axis of the effective portion, and having a number of electron beam passage apertures communicating with the electron beam passage apertures of the effective portion;

said shadow mask body having a plurality of aperture arrays extending parallel to the minor axis and arranged at spaces in the direction of the major axis, each of the aperture arrays including electron beam passage apertures arranged in the direction of the minor axis and bridge portions situated between adjacent electron beams passage apertures;

said auxiliary mask having a plurality of aperture arrays extending parallel to the minor axis and arranged at spaces in the direction of the major axis, each of the aperture arrays including electron beam passage apertures arranged in the direction of the minor axis and bridge portions situated between adjacent electron beams passage apertures; and each of the electron beam passage apertures of the auxiliary mask having a minor-axis-direction diameter twice or more as large as the minor-axis-direction diameter of each electron beam passage aperture of the shadow mask body, the minor-axis-direction space between the electron beam passage apertures of the auxiliary mask being twice as long as the minor-axis-direction space between the electron beam passage apertures of the shadow mask body, the bridge portions of the auxiliary mask being superposed on the bridge portions of the shadow mask body.

15. A color cathode ray tube comprising:

a panel provided with a phosphor screen;

an electron gun for emitting an electron beam toward the phosphor screen; and a shadow mask assembly located between the phosphor screen and the electron gun, the shadow mask assembly including a shadow mask body having a rectangular effective portion opposed to the phosphor screen and formed having a large number of electron beam passage apertures, the effective portion having a major axis and a minor axis passing through the center thereof and extending at right angles to each other, a mask frame to which the periphery of the shadow mask body is fixed, and an auxiliary mask in the form of a strip extending in the direction of the minor axis, fixed to a region containing the minor axis of the effective portion, and having a number of electron beam passage apertures communicating with the electron beam passage apertures of the effective portion;

said shadow mask body having a plurality of aperture arrays extending parallel to the minor axis and arranged at spaces in the direction of the major axis, each of the aperture arrays including electron beam passage apertures arranged in the direction of the minor axis and bridge portions situated between adjacent electron beams passage apertures;

said auxiliary mask having a plurality of aperture arrays extending parallel to the minor axis and arranged at spaces in the direction of the major axis, each of the aperture arrays including electron beam passage apertures arranged in the direction of the minor axis and bridge portions situated between adjacent electron beams passage apertures, the effective portion of the shadow mask body having a superposed region overlapping the auxiliary mask and a non-superposed region situated outside the superposed region;

a minor-axis-direction space between the electron beam passage apertures in the superposed region being twice as long as the minor-axis-direction space between the electron beam passage apertures in the non-superposed region, the minor-axis-direction space between the electron beam passage apertures of the auxiliary mask being twice as long as the minor-axis-direction space between the electron beam passage apertures in the non-superposed region; and the bridge portions of the auxiliary mask being located on the bridge portions of the shadow mask body so as to be shifted in the direction of the minor axis by a margin equal to ½ of the minor-axis-direction space between the electron beam passage apertures of the auxiliary mask.

* * * * *